US005381083A

United States Patent [19]

Inamori et al.

[11] Patent Number: 5,381,083

[45] Date of Patent: Jan. 10, 1995

[54] CONSTANT-CURRENT POWER-SUPPLY CIRCUIT FORMED ON AN IC

[75] Inventors: Masanori Inamori, Tenri; Toshihide Miyake, Nara, both of Japan

[73] Assignee: Sharp Kabushiki Kaisha, Osaka, Japan

[21] Appl. No.: 76,971

[22] Filed: Jun. 16, 1993

[30] Foreign Application Priority Data

Jul. 15, 1992 [JP] Japan ..... 4-187822
Aug. 3, 1992 [JP] Japan ..... 4-206758

[51] Int. Cl.[6] ..... G05F 3/16
[52] U.S. Cl. ..... 323/313; 327/538
[58] Field of Search ..... 323/313, 314, 315, 316, 323/907; 307/296.1

[56] References Cited

U.S. PATENT DOCUMENTS 5,008,736 4/1991 Davies et al. ..... 357/75
5,208,527 5/1993 Polotto et al. ..... 323/313

FOREIGN PATENT DOCUMENTS 325516 2/1991 Japan ..... G05F 1/56

*Primary Examiner*—Kristine L. Peckman

*Assistant Examiner*—Y. Jessica Han

[57] ABSTRACT

There are provided a first constant-current circuit and a second constant-current circuit, and a first resistor connected in series with the first constant-current circuit generates a band-gap voltage. The first constant-current circuit and the second constant-current circuit constitute a current Miller circuit, and a part of a current that flows through the second resistor connected in series with the second constant-current circuit is outputted as a constant current source. The constant-current power supply IC, which has the above-mentioned arrangement, is designed as follows: the first resistor and the second resistor have a predetermined line-width ratio that is determined in such a manner that if the respective line-widths vary by virtually the same value, a varied amount in the second constant current value that has been caused by a variation in the value of resistivity of the first resistor is cancelled by a varied amount caused by a variation in the value of resistivity of the second resistor. This arrangement is effective in compensating function and makes it possible to minimize the error on the constant current output due to deviations that occur during production.

10 Claims, 2 Drawing Sheets

CONSTANT-CURRENT POWER-SUPPLY CIRCUIT FORMED ON AN IC

FIELD OF THE INVENTION

The present invention relates to a constant-current power supply circuit for driving by the use of a constant current a current-driven-type device such as a power transistor.

BACKGROUND OF THE INVENTION

FIG. 1 shows a typical constant-current power supply circuit of the band-gap type and a minute constant-current power supply circuit, which have been conventionally used.

In FIG. 1, Q1 through Q10 are transistors, and R1 through R3 are resistors. Transistor Q1 and transistor Q2 are of the same standard, and transistor Q1 has a parallel connected arrangement the number of which is represented by n, and generates a band-gap voltage. Further, transistors Q4 through Q8 constitute a current Miller constant-current circuit. In this circuit, the following equations hold:

$$V_{BE}(Q2)-V_{BE}(Q1)=I(Q1)\times R1,$$

$$V_T\ln(I(Q2)/I_S)-V_T\ln(I(Q1)/n\cdot I_S)=I(Q1)\times R1,$$

$$V_T\ln(I(Q2)\cdot n/I(Q1)\times R1,$$

where $V_{BE}(\ )$ represents a base-emitter voltage of the transistor that is denoted by a sign seen inside the parentheses ( ); I( ) represents a current at the emitter of the transistor that is denoted by a sign seen inside the parentheses ( ); and R1 represents a value of resistivity of resistor R1. Further, $V_T=kT/q$ (k: Boltzmann's constant, q: electrical charge, T: absolute temperature), and $I_S$ represents a reverse-directional saturated current of the transistor.

Here, I(Q4)=I(Q5) and I(Q1)≅I(Q2) virtually hold because of the current Miller circuit consisted of transistors Q4 and Q5.

Therefore, $$I(Q1)=(V_T/R1)\ln. \quad (1)$$

Here, for example, letting R1=6 KΩ and n=10, $V_T\cong 26$ mV holds; therefore, the following equation holds between I(Q1) and I(Q4):

$$I(Q4)\cong I(Q1)=10\ \mu A.$$

Transistors Q7 through Q10 and resistor R2 constitute a constant-current power supply circuit for generating a constant current $I_{out}$ that is smaller than the value of the current Miller current I(Q4) by one or two figures. The following equations hold in this circuit:

$$V_{BE}(Q7)-V_{BE}(Q8)=I(Q10)\times R2,$$

$$V_T\ln(I(Q7)/I_S)-V_T\ln(I(Q8)/I_S)=I(Q10)\times R2,$$

$$V_T\ln(I(Q7)/I(Q8))=I(Q10)\times R2,$$

$$I(Q7)/I(Q8)=\exp(I(Q10)\times R2/V_T).$$

Therefore, $$I_{out}=I(Q8)=I(Q7)/\exp(I(Q10)\times R2/V_T). \quad (2)$$

Here, the above equations hold on condition that:

$$I_{out}<I(Q10).$$

Letting I(Q4)=10 μA, m=1 and R2=12 KΩ, $$I(Q10)/m=I(Q7)=I(Q4)=10\ \mu A,$$

$$I_{out}\cong 10\ \mu A/\exp(120\ mV/26\ mV)\cong 10\mu A/100=0.1\mu A.$$

As described above, a circuit for supplying a minute constant current in constituted based on the constant-current power supply circuit of the band-gap type that is capable of supplying a comparatively stable constant current in spite of variations of temperatures and source voltage.

Next, FIG. 4 shows another typical constant-current power supply circuit of the band-gap type, which have been used conventionally. In FIG. 4, Q21 through Q27 are transistors, and R20 and R22 through R26 are resistors. The base of transistor Q21 is connected to its own collector and the base of transistor 22, and the emitter of transistor Q21 is connected to ground via resistor R20, while the collector of transistor Q21 is connected to the collector of transistor Q24.

The emitter of transistor Q22 is connected to the emitter of transistor Q23 via resistor R22, while the collector of transistor Q22 is connected to the base of transistor Q23 as well as to the collector of transistor Q25. The collector of transistor Q23 is connected to the base and the collector of transistor Q26 as well as to the bases of transistors Q24, Q25, and Q27. The emitters of transistors Q24, Q25, Q26 and Q27 are connected to Vcc (power source input terminal) respectively via resistors R23, R24, R25 and R26.

Thus, an output current $I_{out}$ is obtained from the collector of transistor Q27. Additionally, transistor Q21 is constituted of transistors, each having the same configuration as transistor Q22, which are connected in parallel with one another, and the number of which is denoted by n. Transistor Q21 thus generates a band-gap voltage. Further, a current Miller constant-current power supply circuit is constituted by transistors Q24 through Q27.

As with the circuit shown in FIG. 1, the following equations hold in the circuit of FIG. 4.

$$V_{BE}(Q22)-V_{BE}(Q21)=I(Q21)\times R20, \quad (3)$$

$$V_T\times\ln(I(Q22)/I_S)-V_T\times\ln(I(Q21)/(I_S\times n)=I(Q21)\times R20.$$

Therefore, $$V_T\times\ln n(I(Q22)/I(Q21))=I(Q21)\times R20, \quad (4)$$

where $V_{BE}(\ )$ represents base-emitter voltage of the transistor that is denoted by a sign seen inside the parentheses ( ); I( ) represents an emitter current in the transistor that is denoted by a sign seen inside the parentheses ( ); and R20 represents a value of resistivity of resistor R20. Further, $V_T=kT/q$ (k: Boltzmann's constant, q: electrical charge, T: absolute temperature), and $I_S$ represents a reverse- directional saturated current of the reference transistor Q22.

Here, the collector current of transistor Q27 that constitutes the current Miller constant-current power supply circuit, that is, the output current $I_{out}$ is given by: $I_{out}=I_{co}(Q24)=I_{co}(Q25)$ (where Ico( ) represents a collector current of the transistor that is denoted by a sign seen inside the parentheses ( )). In this case, it is considered that $I_{out}\cong I(Q21)\cong I(Q22)$; therefore, the equation (4) is rearranged as follows:

$$V_T\times \ln n=I_{out}\times R20, \quad (5)$$

Therefore, $$I_{out}=(V_T/R20)\ln n, \quad (6)$$

Here, for example, letting R20=6 KΩ and n=10, $I_{out}$ is given by:

$$I_{out}\cong 10\mu A.$$

As described above, the constant-current power supply circuit of the band-gap type shown in FIG. 4 is capable of supplying a comparatively stable constant current in spite of variations of temperatures and source voltage. Here, the temperature characteristic of the circuit is approximately +3000 ppm/° C. The reason that the stable constant current is supplied in spite of variations of temperatures and source voltage is because the collector voltages of transistor Q21 and transistor Q22 are always kept at virtually the same voltage and the influence of the Early effect is thus extremely small.

Most of ICs (Integrated Circuits) adopt a constant-current power supply circuit of the band-gap type as a current source, as shown in FIG. 1 and FIG. 4. This is because the constant-current power-supply circuit that requires only a comparatively small current value can be constructed by using resistor R1(R20) having a comparatively small value of resistivity, such as several KΩ in the value of resistivity R1(R20). Further, with the above-mentioned circuit configuration, it is possible to construct a constant-current power supply circuit for generating a constant current that is smaller than the value of the current Miller current by one or two figures by the use of resistors ranging from several KΩ to several tens KΩ.

The resulting constant current is made to be independent of $V_{BE}$ by constructing the transistor using repeated patterns, and the influence of $h_{FE}$ on the current is suppressed to a minimal level with an appropriate circuit configuration. However, as is understood by equation (1) or equation (6), the current value of the constant current is determined by the value of resistivity R1(R20) of resistor R1(R20). This has arisen a disadvantage that if the value of resistivity deviates from a design value due to process deviations which occur during the IC production, the current value of the constant current will fluctuate.

The process deviations of ICs are mainly classified into two types: One type of them, which is generally called "relative deviation", is caused by the fact that characteristics in each individual IC chip shift as a whole in a certain direction and the amount of the shift deviates depending on the respective chips (or wafers). This relative deviation can be virtually solved by installing as closely as possible devices that require conformity in characteristics with one another in their circuit operation.

As to the other type of the process deviations, that is,"absolute deviation", in the case where a constant current that has been generated by the constant-current power supply circuit of the band-gap type is applied to a resistor as a load that has the same configuration as that of resistor R1(R20), and the resulting voltage $V_{out}$ is utilized in the following step or released to an external device, the influence of absolute deviation on the values of resistivity is hardly found because the values of resistivity deviate at the same rate and cancel each other. However, in the case where the current $I_{out}$ is utilized or released as a constant current, the current value deviates in response to the shifted amount of the value of resistivity.

As to absolute deviations of resistors used in an IC, there are two types of them: one is deviation on sheet resistivity that is caused by deviations of the densities of impurities to be injected to produce a resistor; and the other is line-width deviation of resistors that is caused by deviations of etching time, etc. on oxide films that determine the shape of a resistor to be formed. These two types of deviations occur as individual phenomena.

Additionally, in the output circuit of the minute constant current, the current $I_{out}$ also deviates in response to absolute deviation on the value of resistivity because it is produced based on a current generated by the constant-current power supply circuit of the band-gap type.

SUMMARY OF THE INVENTION

It is a primary object of the present invention to provide a constant-current power supply circuit that is capable of supplying a stable constant current by compensating for the influence of line-width deviation of resistors.

In order to achieve the above objective, the constant-current power supply circuit of the present invention is provided with at least the following means:

(a) the first resistor for generating a band-gap voltage;
(b) the first constant-current circuit for generating the first constant current;
(c) the second resistor through which the first current flows; and
(d) the second constant-current circuit for generating the second constant current in response to a voltage that has been generated across the second resistor.

Here, the first resistor and the second resistor have a predetermined line-width ratio that is determined in such a manner that if the respective line-widths vary by virtually the same value, a varied amount in the second constant current value that has been caused by a variation in the value of resistivity of the first resistor is cancelled by a varied amount caused by a variation in the value of resistivity of the second resistor.

With the above arrangement, the constant-current power supply circuit prevents the constant current output value from being adversely affected by the line-width deviation of resistors that occurs during production, and thus provides a compensating function for cancelling the occurrence of a deviation in the constant current output. Consequently, merely by changing a line-width of one resistor, it is possible to achieve a constant-current power supply circuit which can compensate for the adverse effect of the line-width deviation of resistors.

Moreover, in order to achieve the above objective, another constant-current power supply circuit of the present invention is provided with at least the following means:

(e) the first transistor for generating a band-gap voltage;

(f) the first resistor that is connected in series with the emitter of the first transistor;

(g) a current Miller constant-current circuit that is constituted of a plurality of transistors that have a polarity different from that of the first transistor; and (h) a plurality of resistors that are respectively connected to the emitters of the transistors that constitute the current Miller constant-current circuit.

Here, the emitter of the first transistor is connected to the collector of the second transistor, which is one of the transistors that constitute the current Miller constant-current circuit. Further, the line-widths of the first resistor connected to the first transistor, the second resistor connected to the second transistor and the resistors respectively connected to the transistors except the second transistor that constitute the current Miller constant-current circuit are determined so as to have respective ratios with one another.

With the above arrangement, since the line-widths of the first resistor connected to the first transistor, the second resistor connected to the second transistor and the resistors respectively connected to the transistors except the second transistor that constitute the current Miller constant-current circuit are altered in the predetermined ratios with one another, it is possible to achieve a current Miller constant-current circuit which can cancel the line-width deviation, one of the absolute deviations of resistors, and which can thus minimize the deviation in the current value of the constant current.

For a fuller understanding of the nature and advantages of the invention, reference should be made to the ensuing detailed description taken in conjunction with the accompanying drawings.

DESCRIPTION OF THE EMBODIMENTS

Embodiment 1

Figure 1:
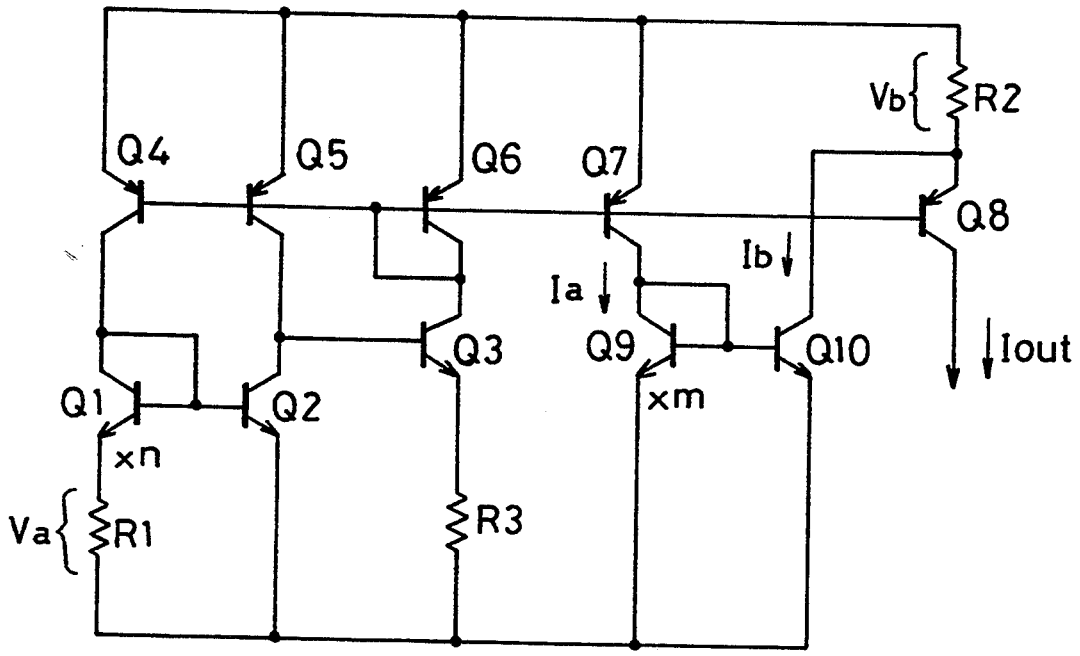
FIG. 1 is a circuit diagram showing a constant-current power supply circuit in the first embodiment of the present invention as well as that of the prior art.

FIG. 1 shows one example of the circuits of the embodiment in accordance with the present invention. The circuit of FIG. 1 represents a constant-current power supply circuit of the band-gap type. The differences between the circuits of the present invention and the prior art can not be seen in the circuit diagram, and the features of the present invention only appear in the process of the formation of the integrated circuit. However, in order to explain the contents of the invention more easily, the following description will be given with reference to the circuit diagram.

The constant-current power supply circuit of the band-gap type of FIG. 1 is constituted of NPN-type transistors Q1, Q2, Q3, Q9 and Q10 and PNP-type transistors Q4 through Q8 as well as resistors R1 through R3. Transistor Q1 is designed in a manner as to have the same characteristics as transistor Q2, and has a parallel connected arrangement the number of which is represented by n. Transistor Q9 is also designed in a manner as to have the same characteristics as transistor Q10, and has a parallel connected arrangement the number of which is represented by m.

In the above-mentioned constant-current power supply circuit of the band-gap type, the current value of the minute constant current $I_{out}$ can be maintained constant independent of deviations in the line-widths of resistor R1 and resistor R2 by determining the line-widths forming resistor R1 and resistor R2 installed on the integrated circuit as described hereinbelow: In the circuit, the following equations hold as was explained in "BACKGROUND OF THE INVENTION".

$$Ia = I(Q1) = Va/R1, \tag{7}$$

(where $Va = V_T \ln n$)

$$Vb = R2 \times Ib, \tag{8}$$

(where $I_{out} < Ib$)

$$Ib = Ia/m, \tag{9}$$

$$I_{out} = Ia/\exp(Vb/V_T) \tag{10}$$

Here, for example, letting R1=6 KΩ and n=10 as well as R2=12 KΩ and m=1, the following equations hold:

$$Ia = Ib \approx 10\ \mu A,$$

$$Vb \approx 120\ mV,$$

$$I_{out} \approx 0.1\ \mu A.$$

From equations (7), (8) and (9), $$Vb = R2 \times Va/(R1 \times m).$$

Therefore, $$R2 \times Va = Vb \times (R1 \times m).$$

If only the rate of change in the line-width deviation of resistors that occurs during production is taken into consideration, the equations can be rearranged to read:

$$(R2+\Delta R2)/R2 = ((R1+\Delta R1)/R1) \times ((Vb+\Delta Vb)/Vb).$$

When the rate of change in the value of resistivity is substituted by the rate of change in the line-width, the above equation can be rearranged to read:

$$r2/(r2+\Delta r2) = (r1/(r1+\Delta r1)) \times ((Vb+\Delta Vb)/Vb),$$

Therefore, $$(r2+\Delta r2)/r2 = ((r1+\Delta r1)/r1) \times (Vb/(Vb+\Delta Vb)), \tag{11}$$

where r1 and r2 represent the respective line-widths of resistors R1 and R2; and Δr1 and Δr2 represent the respective deviations or shifted widths. Here, ΔVb represents the amount of change in the voltage Vb that appears across resistor R2 due to the line-width deviations of resistors R1 and R2.

If it is assumed that resistor R1 and resistor R2 have the same line-width (r1=r2), the shifted amounts of the line-widths of the resistors become the same ($\Delta r1=\Delta r2$), and $\Delta Vb=0$ thus holds, thereby resulting in no change in the voltage Vb.

In order to meet the requirement for maintaining the current $I_{out}$ constant independent of the line-width deviations of the resistors, the amount of change, $\Delta Vb$, in the voltage Vb that appears across resistor R2 has to satisfy the following equation:

$$\Delta Vb=kT/q\ln((r1+\Delta r1)/r1). \quad (12)$$

The following description will give consideration to a concrete example. If it is assumed that resistor R1 of an IC chip has a width of 10 μm and that the line-width of the resistor has a shifted amount of +1 μm, $$\Delta Vb=kT/q\ln((10+1)/10)\simeq 2.645 \text{ mV}.$$

Therefore, when the line-width of the resistor has shifted by +1 μm, it is possible to maintain the current $I_{out}$ constant by increasing the voltage Vb by a voltage value of $\Delta Vb$.

With the substitutions of r1=10 μm, Vb=120 mV, $\Delta Vb=2.645$ mV and $\Delta r1=+1$ μm, equation (11) can be rearranged to read:

$$1+\Delta r2/r2=(11/10)\times(120/122.645)=1.076277,$$
$$r2=\Delta r2/0.076277. \quad (13)$$

Since the shifted amount of the line-width of resistors is virtually constant independent of the line-widths of individual resistors during IC production, the shifted amount $\Delta r2$ of the line-width of resistor R2 is the same as the shifted amount $\Delta r1$ of the line-width of resistor R1:

$$\Delta r2=\Delta r1=1 \text{ μm}.$$

With the substitution of this, equation (13) gives:

$$r2\simeq 13.11 \text{ μm}.$$

The following description will give consideration to another concrete example wherein R1=6 KΩ (a width of 10 μm), R2=12 KΩ (a width of 13.11 μm), n=10 and m=1. Here, the line-width of the resistor has a shifted amount of +2 μm.

$$R1=(10/12)\times 6\ K\Omega=5\ K\Omega,$$

$$Ia=60/5=12\ \mu A,$$

$$R2=(13.11/15.11)\times 12\ K\Omega\simeq 10.41\ K\Omega.$$

Therefore, $$Vb=12\ \mu A\times 10.41\ K\Omega=124.9 \text{ mV}.$$

With the substitutions of Vb and Ia, equation (10) gives:

$$I_{out}=12\ \mu A/\exp(124.9 \text{ mV}/26 \text{ mV})\simeq 0.099\ \mu A.$$

The resulting value 0.099 μA shows a theoretical error of approximately −0.001 μA in comparison with a value of 0.1 μA that is obtained when there is no shift.

Further, the following description will give consideration to still another concrete example in the case where the line-width of the resistor has a shifted amount of −2 μm.

$$R1=(10/8)\times 6\ K\Omega=7.5\ K\Omega,$$

$$Ia=60/7.5=8\ \mu A,$$

$$R2=(13.11/11.11)\times 12\ K\Omega\simeq 14.16\ K\Omega.$$

Therefore, $$Vb=8\ \mu A\times 14.16\ K\Omega=113.28 \text{ mV}.$$

With the substitutions of Vb and Ia, equation (10) gives:

$$I_{out}=8\ \mu A/\exp(113.3 \text{ mV}/26 \text{ mV})\simeq 0.102\ \mu A.$$

Similarly, the resulting value also shows a theoretical error of approximately 0.002 μA.

In a conventional circuit, when the line-width of the reference resistor R1 in a constant-current power supply circuit of the band-gap type is shifted by ±20% (10 μm±2 μm), the constant current $I_{out}$ also shifts ±20% (0.1 μA ±0.02 μA). In contrast, the shifted amounts of the embodiments are 1/20 and 1/10. Thus, the deviation is substantially cancelled by the method of the present invention wherein the line-widths of resistors R1 and R2 are changed.

Figure 2:
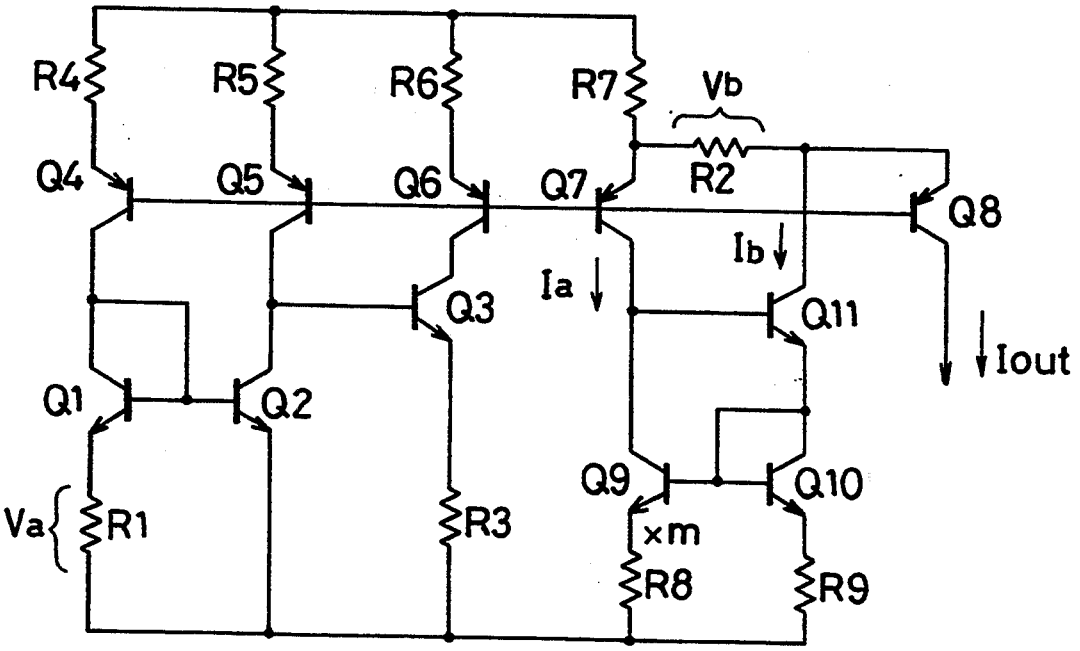
FIG. 2 is a circuit diagram showing another constant-current power supply circuit in the first embodiment.

Additionally, in order to suppress the fluctuation of the constant current caused by the Early effect etc. in a current Miller circuit, a circuit configuration as shown in FIG. 2 may be adopted. In the circuit configuration of this type, by setting the line-widths of resistors R1 and R2 in the same manner as described in the circuit of FIG. 1, it is possible for the constant current $I_{out}$ to cancel the influence of line-width deviations of resistors.

Additionally, in the embodiment, explanation was given on the current source using transistors of the PNP type; yet, a current source using transistors of the NPN type, each having the reversed polarity, may be adopted.

As described above, merely by changing a line-width of one resistor, it is possible to achieve a constant-current power supply circuit which can compensate for the adverse effect of the line-width deviation of resistors.

Embodiment 2

Figure 3:
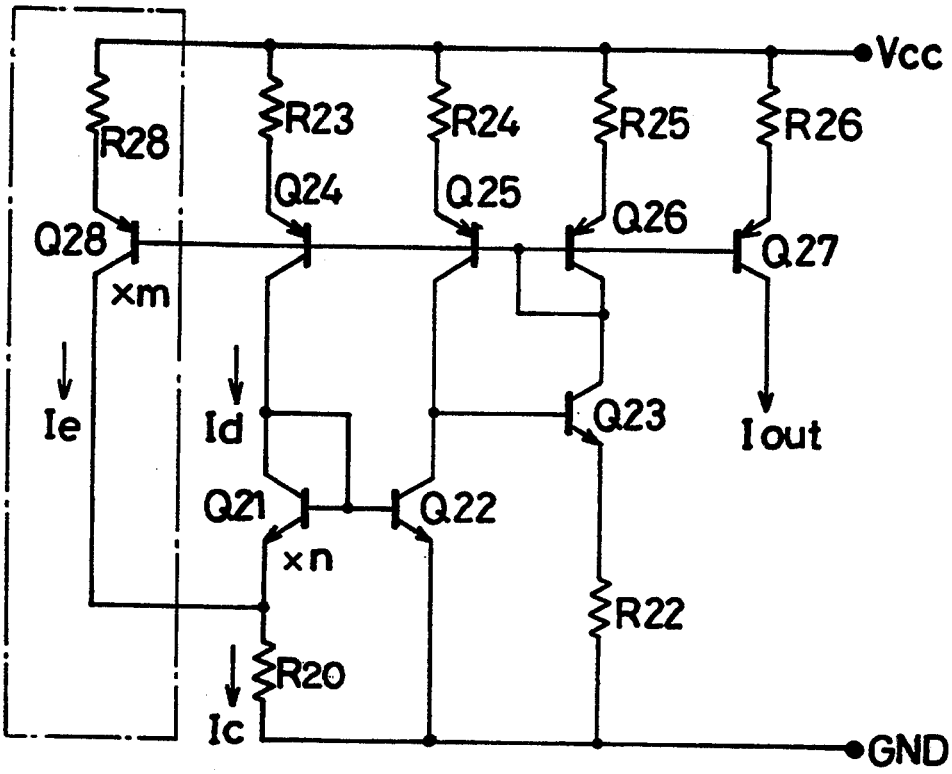
FIG. 3 is a circuit diagram showing a constant-current power supply circuit in the second embodiment of the present invention.

Referring to FIG. 3, the following description will discuss the second embodiment of the present invention.

Figure 4:
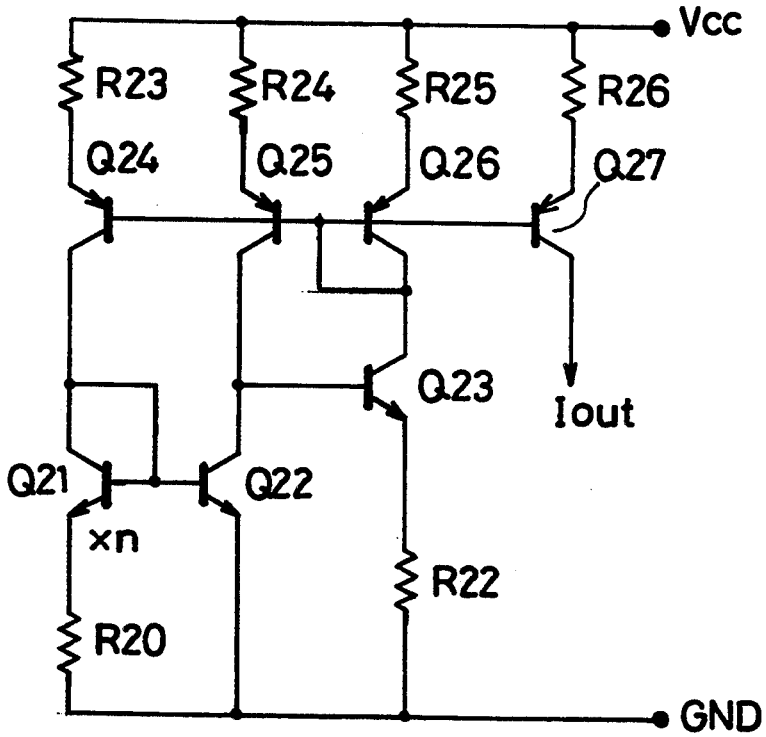
FIG. 4 PRIOR ART
FIG. 4 is a circuit diagram showing another constant-current power supply circuit of the prior art.

As to the circuit configuration, this constant-current power supply circuit of the band-gap type is the one that is constructed by supplementing the prior art circuit of FIG. 4 with a circuit enclosed by the broken line, that is, transistor Q28 and resistor R28. Here, those devices that have been described with reference to FIG. 4 are indicated by the same reference numerals.

The base of transistor Q28 is connected to the bases of transistors Q24 through Q27; the collector of transistor Q28 is connected to the emitter of transistor Q21, which generates a band-gap voltage; and the emitter of transistor Q28 is connected to Vcc via resistor R28. Further, the emitter of transistor Q21 is connected to ground via resistor R21. A current Miller constant-current circuit is constructed by transistors Q24 through Q28.

Here, the respective line-widths of resistor R28 that is connected to the emitter of transistor Q28 of the current Miller constant-current circuit, resistors R23 through R26 that are connected to the emitters of the other transistors Q24 through Q27 of the current Miller constant-current circuit and resistor R21 that is connected to the emitter of transistor Q21 that generates a band-gap voltage are altered so as to have predetermined ratios with one another.

The operation of the constant-current circuit of FIG. 3 is described hereinbelow. As described above, since the line-widths of resistor R28, resistors R23 through R26 and resistor R21 are altered so as to have the predetermined ratios with one another, it is possible to cancel the fluctuation of the constant current caused by the line-width deviation, one of the absolute deviations of resistors, thereby minimizing the fluctuation in the current value of the constant current.

The current Miller current Ie flowing through transistor Q28 is all directed to resistor R21; therefore, the following equation is derived from the aforementioned equation (5).

$$V_T \times \ln n \approx (Ie + I_{out}) \times R21. \quad (14)$$

Therefore, $$R21 \approx (V_T/(Ie + I_{out})) \times \ln n. \quad (15)$$

Here, letting $Ie = I_{out} = 10\ \mu A$, n=10 and m=1, equation (15) gives R21=3 KΩ with respect to resistor R21, as in the case of FIG. 4. Thus, resistor R21 need be set to have a value of resistivity 1/(m+1) times the value of resistivity R20 of resistor R20 in FIG. 4.

Next, assuming the line-width of resistor R21 is W1, that of resistors R23 through R26 is W2, and that of resistor R28 is W3, an explanation will be given on the requirements of the respective line-widths of the resistors under which the line-width deviations of resistors can be cancelled in the above assumptions.

The line-width deviations of resistors do not occur in proportion to the line-widths of individual resistors. They occur because the line-widths are shifted by the same amount in all the resistors in a chip independent of the line-widths of the individual resistors, and because the shifted amount deviates. Here, the shifted amount is denoted by X.

First, in order to set $I_{out}$ to be a constant current (10 μA) independent of the line-widths of the resistors, it is necessary to also set I(Q24) and I(Q25) to be a constant current (10 μA) in the same manner as $I_{out}$. For this reason, the amount of change in the voltage applied across resistors R23 through R26 with respect to the shifted amount of the line-widths of the resistors is determined by the design value W2 of the line-width of the resistors and the shifted amount X because the current is constant, and represented by W2/(W2+X).

Next, the amount of change in the current Ie to be supplied from transistor Q28 is derived from the design value W1 of the line-width of resistor R21 and the shifted amount X, and represented as follows:

$$1 + (m+1)/m \times ((W1 + X)/W1 - 1).$$

When explained assuming that there is no difference between $V_{BE}$ of transistor Q24 and $V_{BE}$ of transistor Q28, the relationship of the above-mentioned amounts of change in the voltage and current is represented as follows:

$$W2/(W2+X) = W3/(W3+X) \times (1 + (m+1)/m \times ((W1+X)/(W1-1)).$$

The above equation is rearranged to read:

$$1/W3 = 1/W2 + (m+1)/m \times W1 + (m+1) \times X/m \times W1 \times W2.$$

Therefore, the following equation holds:

$$W3 = m \times W1 \times W2/(m \times W1 + (m+1) \times W2 + (m+1) \times X). \quad (16)$$

The shifted amount X of the line-widths of the resistors still remains in the above equation; therefore, the deviations of the line-widths of the resistors are not entirely cancelled. However, by setting W1, W2 and m to be slightly larger, the line-width deviations of the resistors can be cancelled as much as possible.

For example, if it is assumed that the line-width W1 of resistor R1 is 12 μm, the line-width W2 of resistors R22 through R26 is 6 μm, and m=2, the line-width W3 of resistor R28 is determined by equation (16) in order to entirely cancel the line-width deviations of the resistors in the case where the shifted amount X of the line-widths of the resistors is first set to +1 μm:

W3=3.2 μm.

Next, in order to entirely cancel the line-width deviations of the resistors, the line-width W3 of resistor R28 that is determined by equation (16) in the case where the shifted amount X of the line-widths of the resistors is set to −1 μm:

W3=3.69 μm.

As the results of these calculations, it is found that there is no line-width W3 of resistor R28 which can cancel all the shifted amount of the line-widths of the resistors. Here, with the substitution of X=0, which is an intermediate value of the above figures, as the shifted amount of the line-widths of the resistors, W3 calculated as follows:

W3=3.43 μm.

Referring to the circuit of FIG. 3, the following description will discuss the fluctuation of $I_{out}$ due to the line-width deviations in the case where resistor R28 having the above-mentioned line-width is used.

In the circuit of FIG. 3, assuming that the current flowing through resistor R21 is Ic and that the current flowing through the collector of transistor Q21 is Id, the following equation holds:

$$I_{out} = Id = Ic - Ie. \quad (17)$$

Further, assuming that there is no difference between $V_{BE}$ of transistor Q24 and $V_{BE}$ of transistor Q28, the following equation holds:

$$Id \times R23 = Ie \times R28.$$

Therefore, $$Ie = Id \times R23/R28. \quad (18)$$

Moreover, in the circuit of FIG. 3, the following equation holds:

$$Ic = \Delta V_{BE}/R21. \quad (19)$$

When Ic and Ie are erased from equations (17), (18) and (19), they are rearranged to read:

$$\Delta V_{BE}/R21 = Id + Id \times R23/R28 = Id \times (1 + R23/R28).$$

Therefore, $$Id = V_T \times \ln n/(R21 + R23 \times R21/R28). \quad (20)$$

In order to make the output current $I_{out}$ the same as the output current described in FIG. 4, resistor R21 of FIG. 3 need be set to have a value of resistivity, R21, 1(m+1) times the value of resistivity R20 of resistor R20 of FIG. 4, as explained earlier. Therefore, the following equation holds:

$$R21 = R20/(m+1). \quad (21)$$

Further, the ratio of values of resistivity between resistor R24 and resistor R28 is represented by:

$$R21/R28 = m. \quad (22)$$

With the substitutions of equation (21), equation (22) and the rate of change in the value of resistivity caused by the line-width deviation, equation (20) is rearranged to read:

$$Id = V_T \times \ln n/((R20/(m+1) \times (1 + X/W1)) + (m/(m+1) \times (R20 \times (1 + X/W3)/(1 + X/W1) \times (1 + X/W2))). \quad (23)$$

With the substitutions of m=2, W1=12 μm, W2=6 μm and W3=3.43 μm, equation (23) gives:

$$Id = V_T \times \ln n/((R20/3 \times (1 + X/12)) + (\tfrac{2}{3}) \times (R20 \times (1 + X/3.43)/(1 + X/12) \times (1 + X/6))). \quad (24)$$

When X=1 μm, with the substitution of this, equation (24) gives:

$$Id = 1.011 \times V_T \times \ln n/R20.$$

When X=−1 μm, with the substitution of this, equation (24) gives:

$$Id = 1.018 \times V_T \times \ln n/R20.$$

In the above equations, 1.011 and 1.018 represent the fluctuation of the current Id. Here, comparison is made between this fluctuation and the fluctuation in the prior art circuit of FIG. 4. In the prior art circuit of FIG. 4, the output current $I_{out}$ is represented by:

$$I_{out} = Id = V_T \times \ln n/(R20/(1 + X/W1)).$$

Assuming that the line-width of resistor R21 is 12 μm, the current Id is represented as follows in the case of the shifted amount X=1 μm.

$$Id = 1.083 \times V_T \times \ln n/R20.$$

In the case of the shifted amount X=−1 μm, the current Id is represented as follows:

$$Id = 0.917 \times V_T \times \ln n/R20.$$

As described above, in the prior art circuit, when the shifted amount of the line-width of the resistor varies by ±1 μm, the output current $I_{out}$ fluctuates by ±8.3%. In contrast, in the circuit of the present embodiment, the fluctuation of the output current $I_{out}$ is suppressed to ±1.8%. Thus, this arrangement makes it possible to achieve a constant-current power supply circuit which can cancel the line-width deviations of resistors to a certain extent.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1.A constant-current power supply circuit, which is formed on an IC, comprising:

first resistor means for generating a band-gap voltage, the first resistor means being formed on the IC;

a first constant-current circuit means for generating a first constant current that is set by the first resistor means by using the band-gap voltage;

second resistor means through which the first constant-current flows, the second resistor means being formed on the IC; and second constant-current circuit means for generating and releasing a second constant current in response to a voltage that has appeared across the second resistor means, wherein the first resistor means and the second resistor means, formed on the IC, have set values of resistivity that are respectively determined by first and second line widths and the first and second line widths are determined in such a manner that, even if the first and second line widths vary by virtually the same value at the time of a manufacturing process of the IC, the variation in the value of the second constant current, which is caused by the variation in the value of resistivity of the second resistor means due to the variation in the second line width, comes to cancel a varied amount in the second constant current value, which has been caused by a variation in the value of resistivity of the first resistor means due to the variation of the first line width.

2. The constant-current power supply circuit as defined in claim 1, wherein the first resistor means is connected in series with the first constant-current circuit means and the second resistor means is connected in series with the second constant-current circuit means.

3. The constant-current power supply circuit as defined in claim 1, wherein the first and the second Constant-current circuit means are respectively constituted of current Miller circuits, each current Miller circuit having transistors that have a polarity opposite to that of transistors of the other current Miller circuit.

4. The constant-current power supply circuit as defined in claim 3, wherein the first constant-current circuit means is constituted of a current Miller circuit having a first transistor and a second transistor and the first resistor means is connected in series with the emitter of the first transistor.

5. The constant-current power supply circuit as defined in claim 4, wherein the first transistor has a parallel connected arrangement with a plurality of transistors.

6. The constant-current power supply circuit as defined in claim 4, wherein the first transistor and the second transistor are of the same standard.

7. The constant-current power supply circuit as defined in claim 3, wherein the second resistor means is connected in series with the emitter of one of the transistors constituting the current Miller circuit in the second constant-current circuit.

8. A constant-current power supply circuit which is formed on an IC comprising:

a first transistor for generating a band-gap voltage;

a first resistor for setting a first constant current by the use of the band gap voltage, the first resistor connected in series with the emitter of the first transistor;

a plurality of transistors whose polarity is different from the polarity of the first transistor;

a current Miller constant current circuit for generating and releasing a second constant current in accordance with the first constant current; and second resistors for setting the second constant current, the second resistors being connected to the emitters of the plurality of transistors respectively, wherein the first resistor and the second resistors, formed on the IC, have set values of resistivity that are respectively determined by first and second line widths and the first and second line widths are determined in such a manner that, even if the first and second line widths vary by virtually the same value at the time of a manufacturing process of the IC, the variation in the value of the second constant current, which is caused by the variation in the value of resistivity of the second resistors due to the variation in the second line width, comes to cancel a varied amount in the second constant current value, which has been caused by a variation in the value of resistivity of the first resistor due to the variation of the first line width.

9. The constant-current power supply circuit as defined in claim 8, wherein the first transistor has a parallel connected arrangement with a plurality of transistors.

10. The constant-current power supply circuit as defined in claim 8, wherein the first transistor,in cooperation with transistors of the standard, constitute the current Miller circuit.

* * * * *